US006558280B1

(12) United States Patent
Kuhn

(10) Patent No.: US 6,558,280 B1
(45) Date of Patent: May 6, 2003

(54) ARROW FERRULE DEVICE

(76) Inventor: Todd A Kuhn, 5660 Bob White Trail, Mims, FL (US) 32754

( * ) Notice: Subject to any disclaimer, the term of this patent is extended or adjusted under 35 U.S.C. 154(b) by 0 days.

(21) Appl. No.: 10/042,466

(22) Filed: Jan. 10, 2002

(51) Int. Cl.[7] ..... F42B 6/04
(52) U.S. Cl. ..... 473/578
(58) Field of Search ..... 473/578, 582, 473/585, 586

(56) References Cited

U.S. PATENT DOCUMENTS 4,900,038 A * 2/1990 Czetto et al.

6,375,586 B1 * 4/2002 Cousins et al. ..... 473/578

* cited by examiner

*Primary Examiner*—John A. Ricci

(57) ABSTRACT

The invention is a cylindrical arrow ferrule device that is inserted between the arrowhead and the main shaft of an arrow or as an integral part of a hollow arrow shaft. A key feature of the invention is an internal actuator that slides down an inner chamber of the device. Prior to impact, this actuator is magnetically coupled to the aft wall of the chamber; but, upon impact, the resulting force releases the actuator that then slides forward to impact the forward wall of the chamber. This actuation provides the same inelastic collision associated with a dead-blow hammer, thereby driving the arrow into the target.

14 Claims, 3 Drawing Sheets

Prior Art
1
2
3
4
5
7
8
9
12

ARROW FERRULE DEVICE

BACKGROUND OF THE INVENTION

1. Field of the Invention

The present invention relates to the field of archery. Specifically, the invention describes a device, attached to or integral with an arrow shaft, which provides greater penetration than conventional shafts alone.

2. Description of the Prior Art

The act of hunting with a bow and arrow is an ancient art. Mankind has sought many ways to increase hunting success through improvements to this basic equipment. Increasingly more powerful bows have proven capable of launching arrows greater distances and with greater force. To make flight dynamics more predictable and accurate, arrows are now precision manufactured from balanced aluminum or graphite shafts and guided by carefully placed fletching. Arrowheads include broad-tipped blades designed to cut a large wound in a target animal, increasing the probability that a critical organ can be struck.

Yet, for all this technology, one fundamental shortcoming of arrow design has never been addressed. Contemporary arrows rely upon the mass and speed of the arrow to drive deep into the target animal. In this manner, modern arrows are no more advanced than their ancestors. A common problem arises when an arrow strikes a solid object, such as a bone, upon penetration. Such an arrow often rebounds from the elastic force of this collision and further penetration is decreased or stopped altogether. An animal wounded in such a way may escape or die weeks later, long after the hunter has lost track of his quarry. Moreover, many vital organs, such as those of the torso, are naturally protected by bones, making it likely that such a problem may arise. Bow hunters are therefore forced to aim for smaller, unprotected parts of the anatomy, such as the heart, which are significantly more difficult to hit.

The only previous attempt to overcome this problem has been to make the arrow, or just the arrowhead, heavier. However, this is a poor solution that greatly reduces the effective range of the arrow and does not overcome the inherent elastic collision that will still take place if a bone is struck upon penetration of the target.

SUMMARY OF THE INVENTION

The present invention is an arrow ferrule device that delivers significantly better arrow energy transfer upon impact resulting in better arrow penetration. The device appears outwardly to be a cylindrical extension of an arrow shaft, inserted between the arrowhead and the main shaft of the arrow, or as an integral insert placed in the hollow end of an arrow shaft. The invention is compatible with all contemporary arrow shafts.

A key feature of the present invention is an internal actuator that slides down an inner chamber of the device. Prior to impact, this actuator is magnetically coupled to the aft wall of the chamber; but, upon impact, the resulting force releases the actuator that then slides forward to impact the forward wall of the chamber. This actuation provides the same inelastic collision associated with a dead-blow hammer, thereby driving the arrow home in the target.

DESCRIPTION OF THE PREFERRED EMBODIMENTS

Figures 1A, 1B:
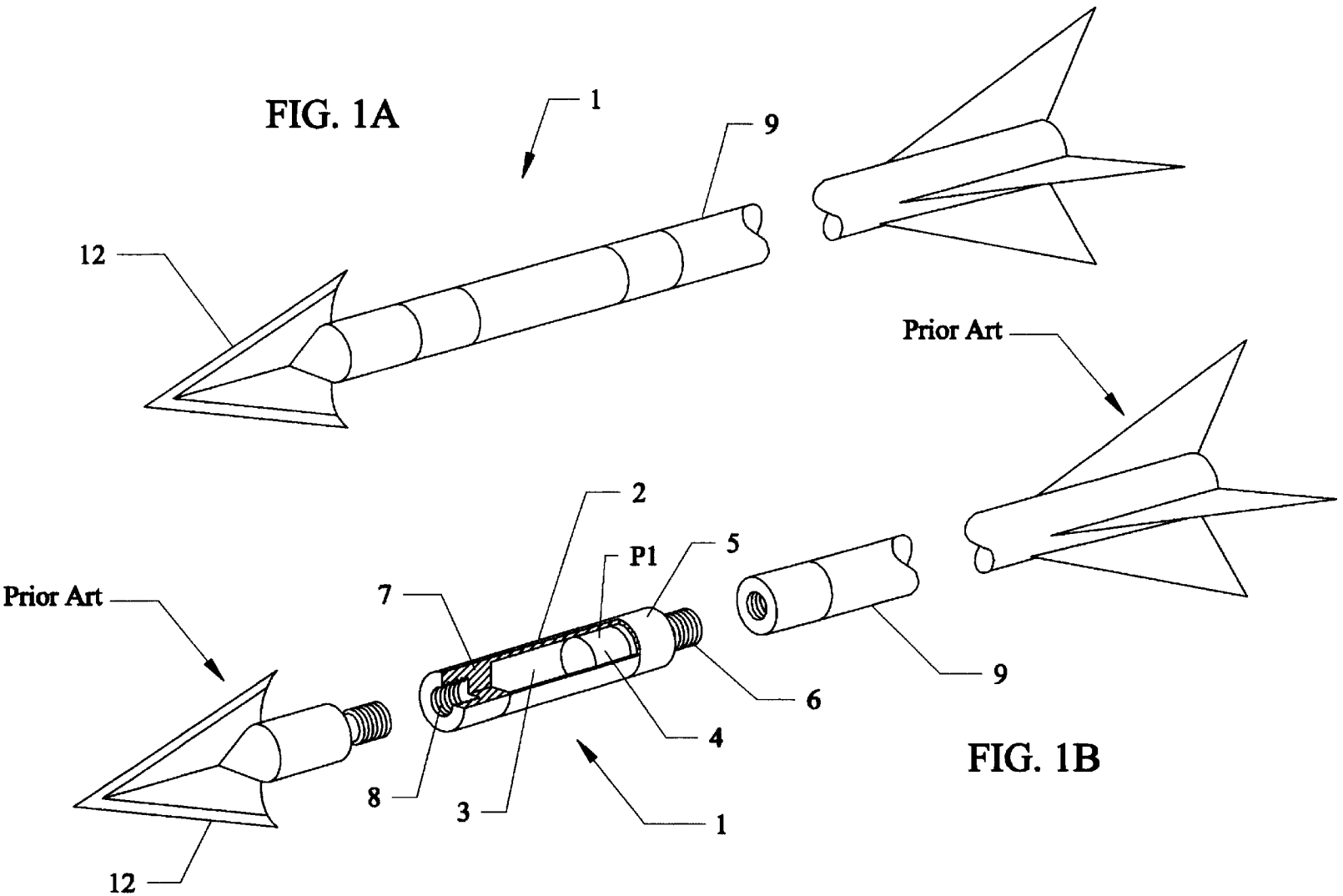
FIGS. 1A and 1B are an oblique view of a first embodiment of the present invention, depicting the relationship between the invention and prior art arrowheads, shafts, and fletching.

FIG. 1 is directed to the preferred embodiment of the present invention. The main body of arrow ferrule device 1 consists of a cylindrical housing 2 encapsulating a hollow chamber 3 of uniform cross-sectional geometry. The cross-sectional geometry of hollow chamber 3, as depicted in FIG. 1, is uniformly circular down the long axis of the present invention, thereby resulting in a hollow chamber 3 which is cylindrical in shape. This geometry is not meant to be limiting, however. Hollow chamber 3 could easily be square or hexagonal in cross section without affecting the operation of the present invention. The wall thickness of housing 2 is typically 1/32 to 1/64 of an inch as determined by overall weight considerations for the device. Housing 2 can be manufactured from aluminum, ABS, nylon, polyethylene, polypropylene, Delrin™, Teflon™, composites, or other structural materials known in the art.

Hollow chamber 3 is sealed at a first end by an integral, solid cylindrical forward billet 7. Forward billet 7 has the same outer diameter as housing 2 and may be machined from the same material as housing 2. Forward billet 7 and housing 2 can also be manufactured from separate and even non-identical materials which can be permanently assembled by any technique known in the art such as welding, adhesive bonding, or friction bonding. The forwardmost, external face of forward billet 7 may include a countersunk female thread 8 of correct pitch, diameter, and depth to accept the male thread on the rear of any typical prior art arrowhead 12. Alternatively, forward billet 7 may include any arrowhead attachment means known in the art of arrow making for attaching an arrowhead to an arrow shaft. Such arrowhead attachment means may be, without limitation, one of adhesive bonding, welding, or friction fit.

Hollow chamber 3 is sealed at a second end by an integral, solid cylindrical aft billet 5. Aft billet 5 has the same outer diameter as housing 2. The aftmost, external face of aft billet 5 includes an integral male thread 6 of correct pitch, diameter, and depth to mount in the female thread located in the forward end of any typical prior art arrow shaft 9. Alternatively, aft billet 5 may include any means known in the art of arrow making for attaching an additional shaft element to an arrow shaft. Such shaft attachment means may be, without limitation, one of adhesive bonding, welding, or friction fit.

Aft billet 5 is manufactured in whole or in part from any material that will be attracted to a permanent magnet, such as iron-containing materials for example, and assembled with housing 2 by any technique known in the art such as welding, adhesive bonding, or friction bonding.

Hollow chamber 3 contains a solid actuator 4 that has a maximum cross section slightly less than the maximum cross section of hollow chamber 3, yet actuator 4 is of identical cross-sectional geometry to hollow chamber 3. Actuator 4 can slide freely back and forth within hollow chamber 3. Actuator 4 is relatively heavy, being comprised in whole or in part of any material that exhibits permanent magnetism.

Figure 2:
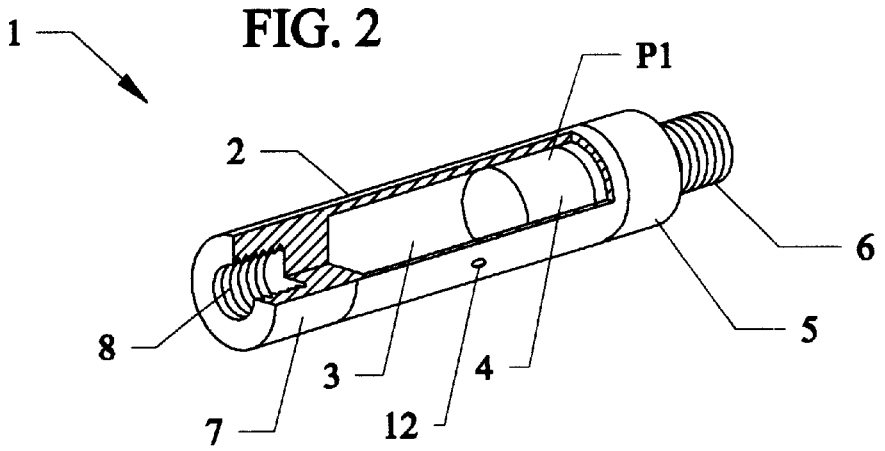
FIG. 2 is an oblique view of a first embodiment of the present invention showing the device actuator in a first position.
Figure 3:
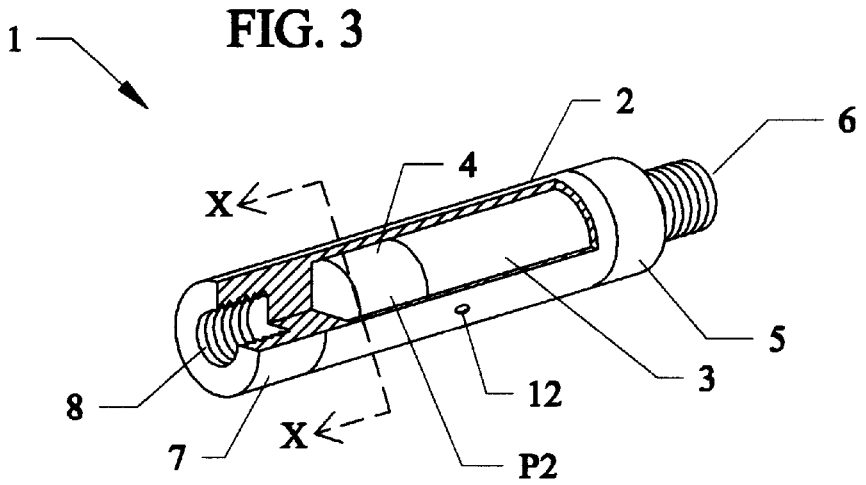
FIG. 3 is an oblique view of a first embodiment of the present invention showing the device actuator in a second position.

The present invention is remarkably easy to operate. The hunter attaches the invention between any conventional arrow shaft and arrowhead. Actuator 4 is slid toward aft billet 5 until the two elements become magnetically coupled (position P1) as shown in FIG. 2. This configuration can be maintained indefinitely (as in the hunter's quiver) until fired at a target. Once fired, the arrow strikes the target with enough impulse force to overcome the magnetic coupling of actuator 4 to aft billet 5. Actuator 4 then slides quickly forward to position P2, striking forward billet 7 and driving the arrowhead hard into the target as shown in FIG. 3.

The magnetic coupling of actuator 4 to aft billet 5 is critical to the operation of the present invention. While the present specification has described actuator 4 as comprising a material that exhibits permanent magnetism and aft billet 5 as comprising any material that is attracted to a permanent magnet, one of ordinary skill in the art would readily recognize that the materials of actuator 4 and aft billet 5 could be reversed while still preserving the critical magnetic coupling of the present invention. In other words, aft billet 5 could be manufactured in whole or in part from a material that exhibits permanent magnetism and actuator 4 could be manufactured in whole or in part from a material that is attracted to a permanent magnet.

Because this actuation occurs very quickly upon impact of an arrow utilizing the present invention, there are some practical limitations on the ratio of actuator 4 axial length to total axial length of hollow chamber 3. If this ratio is too small, actuator 4 must travel a great distance before contacting forward billet 7, all the while losing energy to friction with the inner surface of hollow chamber 3. If this ratio is too large, actuator 4 will have little axial travel and thereby fail to adequately provide the dead-blow hammer effect that is critical to the present invention. Without limitation, the optimal ratio of actuator 4 axial length to total axial length of hollow chamber 3 lies in the range of 25–75%.

Actuator 4 need not be cylindrical. Actuator 4 could be spherical without changing any geometry of hollow chamber 3 or housing 2. However, one in the art would readily recognize that the only physically limiting factor of the present invention is that actuator 4 and hollow chamber 3 must have similar or non-interfering cross-sectional geometry when viewed along line X–X' so that actuator 4 can slide freely inside hollow chamber 3.

Several enhancements can be employed to increase the effectiveness of the present invention. Manufacturing in an ambient environment introduces air into hollow chamber 3. This air will still be present once hollow chamber 3 is sealed by forward billet 7 and aft billet 5. This air will cause some resistance, though miniscule, (like wind resistance to any blunt object) as actuator 4 slides through hollow chamber 3. Such resistance can be eliminated by conducting the final manufacturing step of sealing hollow chamber 3 inside a vacuum chamber so that hollow chamber 3 is completely devoid of air. Another option is the inclusion of at least one small, optional sidewall vent 12 between the interior of hollow chamber 3 and the atmosphere as shown in FIG. 3.

A second method of increasing the effectiveness of the present invention is to coat the contacting inner surface of hollow chamber 3 and/or the outer surface of actuator 4 with a lubricant such as powdered graphite, spray Teflon™, or other lubricants known in the art.

Figure 4:
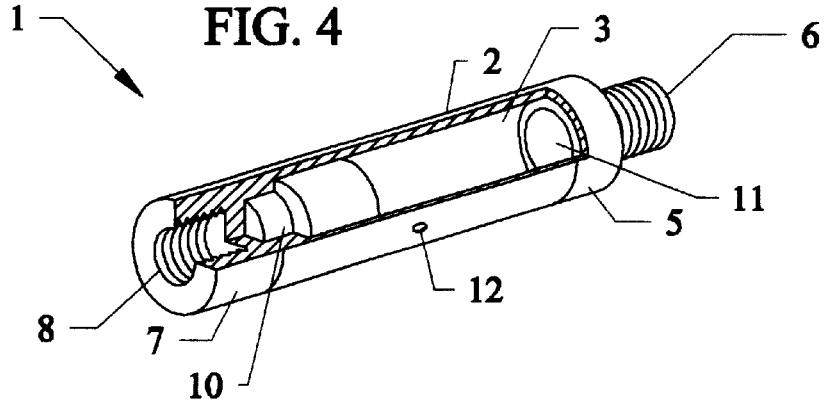
FIG. 4 is an oblique view;of a second embodiment of the present invention.

FIG. 4 describes features of a second embodiment of the present invention. In FIG. 4, like parts are identified by like numbers as found in the first embodiment of FIGS. 1, 2 and 3. Additionally, the embodiment of FIG. 4 includes an integral aft insert 11 on the inner face of aft billet 5. In this embodiment, only aft insert 11 need be manufactured in whole or in part from any material that is attracted to a permanent magnet. The remaining bulk of aft billet 5 can be manufactured from a dissimilar and perhaps less expensive material. Aft insert 11 is assembled to aft billet 5 by any technique known in the art such as welding, adhesive bonding, or friction bonding.

A second additional feature of the embodiment described in FIG. 4 is the inclusion of an integral forward insert 10 on the inner face of forward billet 7. Forward insert 10 is manufactured in whole or in part from any material that is attracted to a permanent magnet. The remaining bulk of forward billet 7 can be manufactured from a dissimilar material. Forward insert 10 is assembled to forward billet 7 by any technique known in the art such as welding, adhesive bonding, or friction bonding. Forward insert 10 magnetically couples with actuator 4 upon impact after actuator 4 breaks the magnetic coupling with aft billet 5 (or aft insert 11 if such is employed) and slides forward toward forward insert 10. This further increases the inelastic nature of the collision between the arrow and its target.

The use of forward insert 10 and aft insert 11 can reduce the overall weight of the present invention. If an arrow becomes too bulky or too unbalanced, overall performance and accuracy can be compromised.

Figures 5A, 5B, 5C:
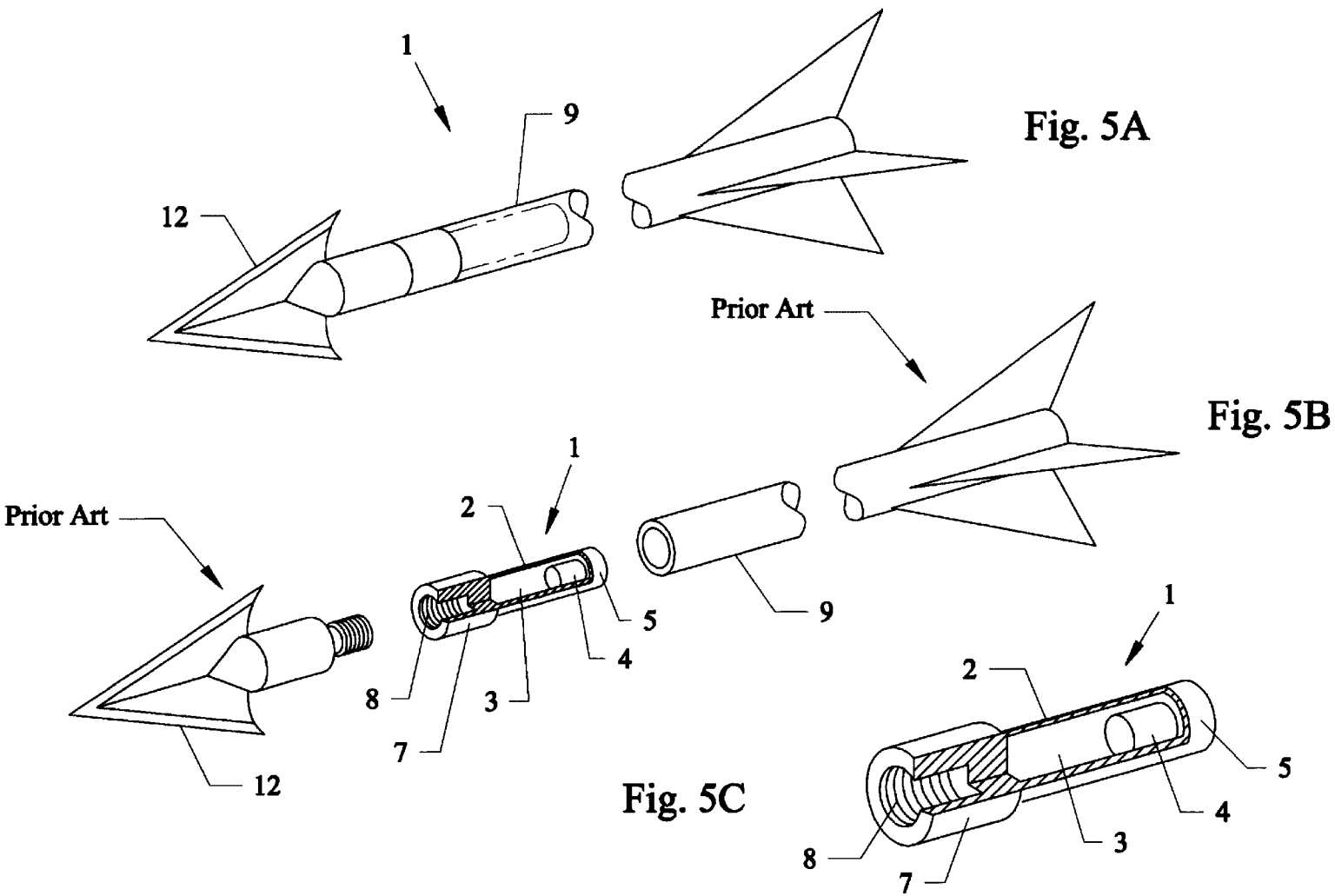
Fig. 5C Prior Art
FIGS. 5A, 5B, and 5C are an oblique view of a third embodiment of the present invention.

FIG. 5 describes features of a third embodiment of the present invention which is designed to be used with hollow prior art arrow shafts. In FIG. 5, like parts are identified by like numbers as found in the first embodiment of FIGS. 1, 2 and 3. Forward billet 7 has the same outer diameter as the prior art arrow shaft 9. However, the maximum outer diameter of housing 2 is reduced to match the inner diameter of prior art arrow shaft 9. Additionally, the embodiment of FIG. 5 deletes the feature of aft thread 6. To assemble the invention with a hollow, prior art arrow shaft 9, housing 2 is inserted into said arrow shaft until forward billet 7 rests firmly against the forward shaft rim. The invention is maintained in this assembled position either through a simple friction fit or by application of any bonding agent or technique, such as adhesive bonding, to the mating external surface of housing 2 and/or internal surface of prior art arrow shaft 9 before assembling.

The embodiments described herein are meant to be exemplary of the present invention and not limiting.

What is claimed is:

1. An arrow ferrule comprising:

a cylindrical housing having first and second ends and encapsulating a hollow chamber;

a solid forward billet, integral to said first end of said cylindrical housing;

a solid aft billet, integral to said second end of said cylindrical housing; and a solid actuator contained within said hollow chamber;

wherein said actuator slides freely along the length of said hollow chamber;

wherein said aft billet is manufactured in whole or in part from any material that is attracted to a permanent magnet;

wherein said actuator is manufactured in whole or in part from any material that exhibits permanent magnetism;

wherein the external, forewardmost face of said forward billet includes an arrowhead attachment means for attaching an arrowhead to said forward billet; and wherein the external, aftmost face of said aft billet includes a shaft attachment means for attaching an arrow shaft to said aft billet.

2. The arrow ferrule device of claim 1, wherein said actuator is cylindrical.

3. The arrow ferrule device of claim 2, wherein said arrowhead attachment means consists of a countersunk female thread of correct pitch, diameter, and depth to accept the male thread on the rear of an arrowhead; and wherein said shaft attachment means consists of an integral male thread of correct pitch, diameter, and depth to mount in the female thread located in the forward end of an arrow shaft.

4. The arrow ferrule device of claim 1, wherein the ratio of the axial length of said actuator to the axial length of said hollow chamber is in the range of 25% to 75%.

5. The arrow ferrule device of claim 1, wherein the contacting surfaces of said actuator and said hollow chamber are coated with a lubricant.

6. The arrow ferrule device of claim 1, further including at least one vent between the interior and exterior surfaces of said hollow chamber.

7. An arrow ferrule comprising:

a cylindrical housing having first and second ends and encapsulating a hollow chamber;

a solid forward billet, integral to said first end of said cylindrical housing;

a solid aft billet, integral to said second end of said cylindrical housing; and a solid actuator contained within said hollow chamber;

wherein said actuator slides freely along the length of said hollow chamber;

wherein said actuator is manufactured in whole or in part from any material that is attracted to a permanent magnet;

wherein said aft billet is manufactured in whole or in part from any material that exhibits permanent magnetism;

wherein the external, forewardmost face of said forward billet includes an arrowhead attachment means for attaching an arrowhead to said forward billet; and wherein the external, aftmost face of said aft billet includes a shaft attachment means for attaching an arrow shaft to said aft billet.

8. The arrow ferrule device of claim 7, wherein the inner face of said forward billet includes a forward insert manufactured in part from any material that is attracted to a permanent magnet.

9. The arrow ferrule device of claim 7, wherein the ratio of the axial length of said actuator to the axial length of said hollow chamber is in the range of 25% to 75%.

10. The arrow ferrule device of claim 7, wherein the contacting surfaces of said actuator and said hollow chamber are coated with a lubricant.

11. The arrow ferrule device of claim 7, further including at least one vent between the interior and exterior surfaces of said hollow chamber.

12. An arrow ferrule comprising:

a cylindrical housing having first and second ends and encapsulating a hollow chamber;

a solid forward billet, integral to said first end of said cylindrical housing;

a solid aft billet, integral to said second end of said cylindrical housing; and a solid actuator contained within said hollow chamber;

wherein said actuator slides freely along the length of said hollow chamber;

wherein said actuator is manufactured in whole or in part from any material that is attracted to a permanent magnet;

wherein said aft billet is manufactured in whole or in part from any material that exhibits permanent magnetism;

wherein the external, forewardmost face of said forward billet includes an arrowhead attachment means for attaching an arrowhead to said forward billet;

wherein the maximum outer diameter of said housing is smaller than the minimum inner diameter of a hollow arrow shaft; and wherein the maximum outer diameter of said forward billet is equal to or greater than the maximum outer diameter of a hollow arrow shaft.

13. The arrow ferrule device of claim 12, wherein the ratio of the axial length of said actuator to the axial length of said hollow chamber is in the range of 25% to 75%.

14. The arrow ferrule device of claim 12, wherein the contacting surfaces of said actuator and said hollow chamber are coated with a lubricant.

* * * * *